US008607486B2

(12) United States Patent
Nielsen et al.

(10) Patent No.: US 8,607,486 B2
(45) Date of Patent: Dec. 17, 2013

(54) CARD FOR PRESENTING INFORMATION DURING WAVING

(75) Inventors: Finn Nielsen, Copenhagen (DK); Rune Domsten, Bronshoj (DK)

(73) Assignee: Cardlab APS, Copenhagen K (DK)

( * ) Notice: Subject to any disclaimer, the term of this patent is extended or adjusted under 35 U.S.C. 154(b) by 832 days.

(21) Appl. No.: 12/310,515

(22) PCT Filed: Aug. 28, 2007

(86) PCT No.: PCT/EP2007/058920

§ 371 (c)(1),
(2), (4) Date: Jun. 7, 2010

(87) PCT Pub. No.: WO2008/025766

PCT Pub. Date: Mar. 6, 2008

(65) Prior Publication Data

US 2010/0263242 A1 Oct. 21, 2010

Related U.S. Application Data

(60) Provisional application No. 60/841,186, filed on Aug. 31, 2006.

(51) Int. Cl.
*G09G 3/00* (2006.01)

(52) U.S. Cl.
USPC ..... 40/442; 345/31; 345/82

(58) Field of Classification Search
USPC ..... 345/31, 82; 40/442
See application file for complete search history.

(56) References Cited

U.S. PATENT DOCUMENTS

| | | | | |
|---|---|---|---|---|
| 3,958,235 | A * | 5/1976 | Duffy | 345/82 |
| 4,311,999 | A * | 1/1982 | Upton et al. | 345/31 |
| 5,791,966 | A | 8/1998 | Capps et al. | |
| 6,265,984 | B1 | 7/2001 | Molinaroli | |
| 6,404,409 | B1 * | 6/2002 | Solomon | 345/31 |
| 6,452,575 | B1 | 9/2002 | Lin | |
| 2004/0155845 | A1 | 8/2004 | Smedley et al. | |
| 2005/0277360 | A1 | 12/2005 | Benedek et al. | |

FOREIGN PATENT DOCUMENTS

| | | |
|---|---|---|
| EP | 0 546 844 | 6/1993 |
| GB | 2 389 218 A | 3/2003 |
| JP | 6-67616 | 3/1994 |
| JP | 3081811 U | 11/2001 |
| JP | 2004-264440 | 9/2004 |
| JP | 2005-517970 | 6/2005 |
| WO | WO 01/93238 A1 | 12/2001 |
| WO | WO 03/009569 | 1/2003 |

OTHER PUBLICATIONS

Campanella, A., et al., TextWand Interactive LED Display, web.mit.edu/6.111/www/s2005/PROJECT/Groups/1/Project1.pdf, 11 pages.
Campanella, A., et al., TextWand Programmable LED Display, web.mit.edu/6.111/www/s2005/PROJECT/Groups/1/Presentation1, 7 pages.

* cited by examiner

*Primary Examiner* — Casandra Davis
(74) *Attorney, Agent, or Firm* — Jacobson Holman PLLC

(57) ABSTRACT

A card for presenting visual information while being waved. The card is flexible and has a sensor detecting or quantifying the bending of the card. The card has, preferably at an edge thereof, light emitters for presenting the information. A controller determines the position of the edge and forwards information so that a user watching the edge sees an emulated 2D information provider.

25 Claims, 1 Drawing Sheet

CARD FOR PRESENTING INFORMATION DURING WAVING

Figure 1:
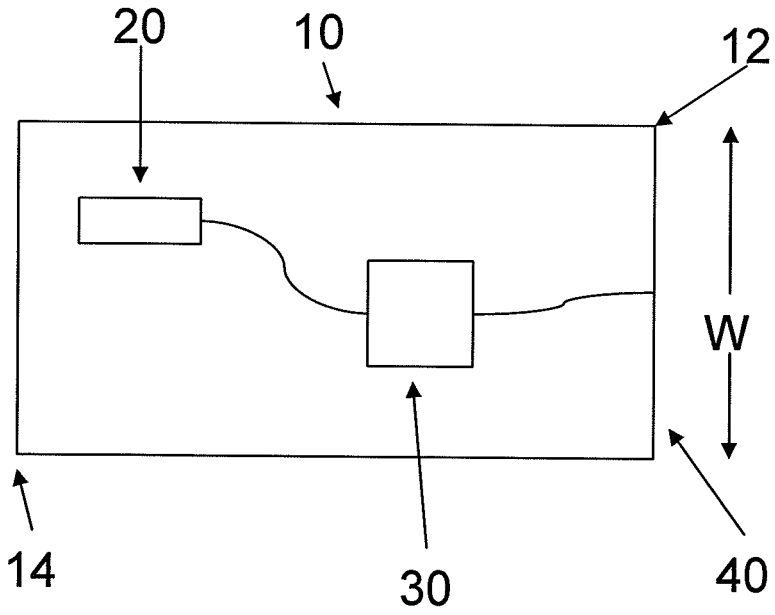

This is a National Stage of PCT/EP2007/058920 filed Aug. 28, 2007 and published in English, claiming benefit of U.S. provisional application No. 60/841,186, filed Aug. 31, 2006.

The present invention relates to a card adapted to present information while being waved or otherwise exposed to a reciprocating movement, and in particular a card adapted to present information while being waved, the information being provided as a result of an acceleration or other bending of the card.

Tops providing information while rotating may be seen in U.S. Pat. No. 5,791,966 or US2005/0277360). In http://www.loadsmorestuff.com/product_info.php?products_id=1085 and http://web.mit.edu/6.111/www/s2005/PROJECT/Groups/1/main.html, products are seen which provide information while being waved. These products, however, are stiff boxes, and seem to be quite simple set-ups.

In a first aspect, the invention relates to a card comprising:

a flexible base element, means for presenting visual information, means for detecting a bending of the base element, means for receiving first information or signals from the detecting means and providing, on the basis of the first information, second information or signals to the presenting means.

In the present context, a flexible element is an element adapted to flex or bend when waved. Waving being e.g. a person holding a part of the element and moving the element in a reciprocal manner. Then, the element will bend or flex due to the changing accelerations and the flexibility thereof as well as wind resistance acting on the card during the waving.

Also, a card, presently, is an element having a dimension with a significantly smaller extent than the other 2 dimensions (thickness vs. width and length), primarily in that this facilitates the bending desired. However, a relatively large "thickness", compared to e.g. credit cards, may be used, as long as the base element remains flexible.

Visual information may be any type of visual information, such as images, pictures, text, or the like. This information will be seen by a person as a 2D image, even though provided by a presenter having a smaller cross section, along one dimension, due to the slow nature of the human eye system.

The detecting or quantification of the bending is able to generate information describing the movement of the presenting means, which information is used by the receiving means controlling the presenting means.

Preferably, the detecting means is positioned at or on a side surface of the base element and is adapted to output a signal corresponding to a stretching/compression of the detecting means. Thus, standard elements, such as piezo electric transducers, strain gauges, or pressure sensitive resistors may be used. Alternatively, more complicated accelerometers may be used.

Some types of accelerometers or bending detectors are actually able to, if fed a suitable signal, output a sound. Thus, in one embodiment, the detecting means are additionally adapted to provide a sound corresponding to a received signal, the card further comprising means for providing a signal to the detecting means.

Preferably, the card has a first edge and one or more opposing edges, the presenting means being positioned at or on the first edge of the card, and the detecting means are positioned closer to the opposing edge(s) than the first edge. In this manner, the card is actually adapted to be held between the opposing edge(s) and the detecting means, whereby waving of the card preferably will create the largest bending at the detecting means.

In a preferred embodiment, the presenting means comprises one or more, normally parallel, rows of light emitters each being controllable by the receiving means. Any number of rows may be used, and any type of light emitter, such as LED, laser, vxel may be used. Monochrome emitters may be used, a mixture of monochrome emitters may be used so that multicolor information may be provided, or a plurality of emitters adapted to emit light of varying color may be used.

Providing the emitters at the edge merely provides the largest waving distance. The emitters may be provided at any position of the card.

Preferably, the card or the receiving means additionally comprises a timing means adapted to provide timing information, the receiving means providing the second information also on the basis of the timing information. Thus, not only the bending/acceleration may be used but also the point in time since, e.g., the last turning point of a movement or the last point in time when no bending/acceleration were sensed.

In a preferred embodiment, the receiving means is adapted to estimate, from the first information and the timing information, a first distance which the providing means moves during a reciprocal movement. Thus, this first distance may be the distance between two extreme points of the reciprocal movement. This distance and the timing information may make the receiving means able to determine, at all points in time, the actual position of the information provider.

Then, the receiving means may be adapted to hold 2D information to be provided, to sequentially forward, to the presenting means, data representing neighboring, elongate parts of the 2D information. When performing the reciprocal movement, the providing means will "scan" the distance, and the receiver will forward information to the provider according to the provider's position along the distance. Then, naturally, the information transmitted to the provider will represent more elongate parts of the overall 2D information, divided across the direction of bending/waving.

Naturally, the above determinations of timing information and position/distance information may be performed repeatedly, as well as the outputting of the second information, in order to constantly track the time/position/distance.

In the situation where the provider has one or more rows of emitters, the receiving means may be adapted to relate a desired extent of the 2D information along a first dimension to the distance and to adapt the number of light emitters of each row of the presenting means (the actual extent of the information provided) to have the 2D information presented by the card during the reciprocating movement have a predetermined relationship between a dimension along the direction of waving and a direction perpendicular thereto.

Thus, if a given image or text is to be provided, the extent along the row of emitters will then vary with the distance of the reciprocal waving. A large distance will then utilize a larger extent of the row of emitters, and a smaller distance will reduce the overall extent of the information also in the direction of the row of emitters.

In another situation, the receiving means are adapted to determine, from the 2D information, a second distance required to present the information and to forward to the presenting means a part of the 2D information corresponding to a relation between the first and second distances. Thus, instead of adapting the direction along the rows of emitters, only a part of the 2D information is provided, if the distance of the reciprocal movement is smaller than the second distance required. Then, the user may wish to wave with a larger movement, or he may wish to firstly "wave" a part of the information and then, such as by moving the card to the side, "wave" the remainder of the information.

In one embodiment, the receiving means is adapted to estimate a curve, in a plane of the bending, adopted by the presenting means, and to adapt the second information accordingly. In fact, this curve need not be estimated. It may be pre-programmed in or known to the receiver. This adaptation may be made to e.g. have the information provided seem as if provided by a plane element instead of a curved element. This will mean that the receiver times the providing of individual parts of the 2D element in a particular manner.

In general, the receiving means may be adapted to estimate, on the basis of the first information and the timing information, a position of the providing means and to provide the second information on the basis of the estimated position. Thus, as it is preferred that the same part of the information is provided at the same position (in order to provide a steady image), this position determination is highly desired.

In a second aspect, the invention relates to a method of operating the above card, the method comprising:

bending the card, the detecting means providing the first information or signals to the receiving means, the receiving means receiving the first information and providing the second information to the presenting means, the presenting means presenting visual information corresponding to the second information.

In one embodiment, the detecting means are positioned at or on a side of the base element and output a signal corresponding to a stretching/compression of the detecting means.

In another embodiment, the detecting means additionally provide a sound corresponding to a signal provided thereto.

In a preferred embodiment, the card has a first edge and one or more opposing edges, the presenting means being positioned at or on the first edge of the card, the bending primarily taking place closer to the opposing edge(s) than the first edge, and where the detecting means are positioned closer to the opposing edge(s) than the first edge.

As mentioned above, the presenting step comprises each light emitter of one or more rows of light emitters being controlled by the receiving means. A large number of emitters may be used.

Preferably, the method further comprises the step of providing timing information, where the second information is determined also on the basis of the timing information.

Then, the method may further comprise the step of estimating, from the first information and the timing information, a first distance which the providing means moves during a reciprocal movement. This may provide knowledge as to the possible extent of the information to be provided.

Then, the receiving means may hold 2D information to be provided, and sequentially forward, to the presenting means, data representing neighboring, elongate parts of the 2D information. In this manner, the information is sequentially provided while the providing means move over the distance of the movement.

In one embodiment, the method may comprise the step of relating an extent of the 2D information along a first dimension to the distance and adapt the extent of the information provided by the presenting step in a direction perpendicular to the direction of bending to have the 2D information presented by the card during the reciprocating movement have a predetermined relationship between a dimension along the direction of waving and a direction perpendicular thereto. Thus, the scale but not the relationship between the dimensions, may be altered by the movement.

In another embodiment, the method comprises the step of determining, from the 2D information, a second distance required to present the information and to forward to the presenting means a part of the 2D information corresponding to a relation between the first and second distances. Then, a too small distance may bring about that only part of the information is provided.

In one embodiment, the method may comprise the step of estimating a curve, in a plane of the bending, adopted by the presenting means, and adapting the second information accordingly. This may be in order to emulate that the information is provided by a plane element, e.g.

In another embodiment, the method comprises the step of estimating, on the basis of the first information and the timing information, a position of the providing means and providing the second information on the basis of the estimated position.

Figure 2:
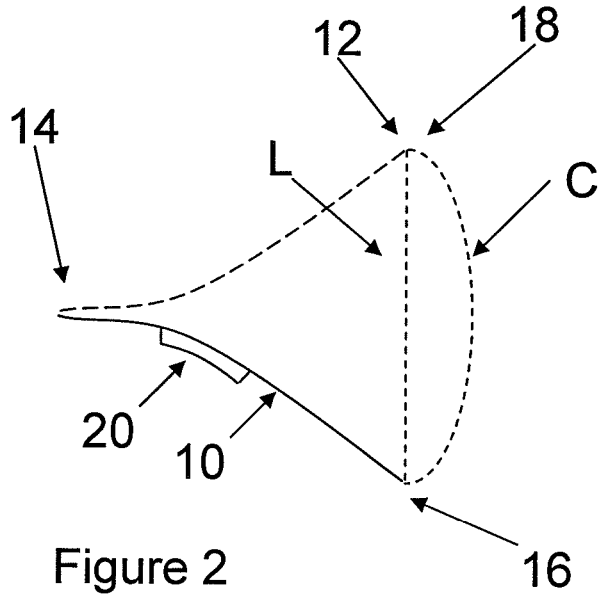

In the following, preferred embodiments of the invention will be described with reference to the drawing, wherein:

FIG. 1 illustrates a card according to a preferred embodiment of the invention, FIG. 2 illustrates the bending during movement/waving of the card.

In FIG. 1, the preferred card 10 comprises, at one edge, 12, a row of light emitters 40. The light emitters 40 are controlled by a receiver or controller 30 which receives information from a bending estimator 20.

The bending estimator may be a piezo electric crystal, a strain gauge, a pressure sensitive resistor or the like. This estimator 20 is provided on the side of the base material (normally plastics) of the card 10 in order for the estimator to be extended or compressed during bending of the card into or out of the plane of the figure and outputs a signal corresponding to the compression/extension.

The estimator and controller may, as the light emitters 40, be laminated into or fixed on the surface of the base of the card as is known in e.g. credit cards.

The present card is adapted to be held at the edge or close to the edge 14 opposite to the edge 12 and to be "waved". This waving will make the card 10 bend, and this bending will provide information as to the movement of the waving. The estimator 20 is positioned close to the edge 14 in that this is the position where the bending will be the largest. Other positions may also be used, even though these will be bent less.

The information or signal from the estimator 20 is fed to the receiver 30 which may then, also based on a timing circuit provided therein, determine either the degree of bending or the position of the edge 12. It is clear that the bending of the card combined with the period of time having elapsed since e.g. a turning point in a reciprocal, waving movement, will point to the position of the edge 12.

In addition, the bending (acceleration) as well as the time elapsing between successive turning points will provide an estimate of the full length of the reciprocal movement.

Thus, the receiver will be able to both estimate the movement of the edge 12 as well as the actual position of the edge 12 and the light emitters 40.

When wishing to provide information using light emitted by the emitters 40, the controller 30 has therein information relating to a 2D image or the like which is to be provided. This image may be a picture, photo, or text. Any type of 2D information may be provided.

As this information is provided during waving and by one or more relatively narrow, elongated row(s) of light emitters, the controller 30 forwards information or signals to the light emitters corresponding to the position of the edge 12 in the reciprocal movement. This information is used by the controller 30 to forward the correct part of the 2D information to the emitters 40 in order for the resulting provided information to correspond to the 2D information. This position determination is relatively important in that the overall image seen would otherwise jump from passing to passing of the reciprocal movement.

In one embodiment, the controller tracks the movement of the edge 12 and adapt the total reciprocal distance to the width of the 2D information in order to be able to present all of the 2D information.

Alternatively, the 2D information may require (in order to have e.g. the correct resolution or the like) a minimum waving distance. If the present waving does not obtain this distance, the controller may decide to provide only a part of the 2D information. Thus, the text "Mickey is a mouse" may be provided, if the minimum distance is obtained, but only "Mickey" or "Mickey is a" is obtained if smaller distances are obtained during the waving. The same will be the situation with an image.

This embodiment may be altered to the situation where not only the relative position of the edge 12 in relation to the edge 14 is tracked but the actual position of the edge 12, whereby waving the card a small distance and providing "Mickey" and then moving the card in the direction from the "M" to the "y" will make the controller provide "is a" instead, and further movement in that direction will provide the "mouse". Thus, a small distance of the waving may be compensated for by a movement of the card in that direction while still waving the smaller distance.

In another embodiment, the extent along the width W of the row of light emitters of the information provided may be varied to take into account the actual distance of the waving. Thus, if the 2D information to be provided should have a certain relation between the direction of W and that perpendicular thereto, a smaller distance of waving may reduce the extent of the provided information along W. Waving a longer distance may make the controller 30 increase the number of light emitters used so as to also increase the extent of the information (such as an image) along the direction of W.

In the example of a text, the controller 30 may alter the font size for the text to be fully represented over the actual distance waved. Waving a larger distance will then make the font size increase.

In one embodiment, the card is also adapted to output a sound. The controller 30 may then hold information relating to the sound. In fact, some bending estimators, such as the piezo electric crystal, may be able to also output sound if receiving a corresponding signal. Thus, the bending estimator may also be used for receiving a signal from the controller 30 and for outputting a corresponding sound. In order to be able to use the estimator 20 for both purposes, it may be desired to only enable the sound outputting action when no bending and light providing takes place.

FIG. 2 illustrates the waving/bending seen from above. The card 10 is illustrated in one extreme position 16, and the other extreme position is illustrated at 18.

The distance travelled by the edge 12 may be seen as that along the actual curve C which the edge travels through, or it may be taken as the position along a straight line L between the extreme points 16, 18.

The user viewing the presented information from the right in the figure will of course see information presented from the curve C. The controller 30, however, may correct the timing of transmitting the individual parts of the information to the emitters 40 so as to emulate the providing of the information on a flat screen. Thus, this requires that the controller 30 does not output all parts (in the direction into and out of the plane of FIG. 2) equally spaced along the curve C, but equally spaced along the line L.

Naturally, the controller 30 may not provide any information before the card has been waved a few times in order for the controller 30 to obtain knowledge about the waving (distance, bending, velocity, acceleration or the like) and to determine how to provide the information at different positions of the movement. Otherwise, or in addition, the controller 30 may be adapted to adapt to changes in waving distance so as to alter the information provided during waving.

Also, the controller 30 may provide the information when moving only in one direction (up-down or down-up in FIG. 2) or it may provide information in both directions.

Any number of rows of light emitters may be used. Also, any type of light emitter may be used (LED, laser, VXEL or the like). Also, monochrome light emitters may be used, such as mixed with other emitters of other colours, or light emitters may be used being able to output varying colours.

The controller 30 may be pre-set for any type of information or may be able to output only predetermined information. The controller 30 may be able to alter the information provided in any suitable manner, such as stochastically or sequentially changing between information stored therein or by communicating with external equipment adapted to enter the information to be provided into the controller 30. This communication may be wireless or via a wire.

Naturally, the card may be provided with multiple sets of estimator 20 and emitters 40, such as when the emitters 40 of another set is provided at another edge, such as the edge 14, and the estimator 20 relating to that set of emitters is provided oppositely, that is, close to the edge 12. In that situation, the two different sets may be used for providing two different messages or information. Also, two different controllers 30 may be provided, or the controller 30 may decide which set to use by determining which estimator 20 detects the largest bending.

Also, 3D images or information may be provided by providing emitting means in different distances from the edge 12. In this manner, a plurality of 2D information is to be provided, one for each set of emitting means—i.e. one for each "depth" for which information is available. These additional emitting means may be provided at a distance from the edge 12 on a side surface of the card 10 or inside the card, if the base material thereof is translucent.

The invention claimed is:

1. A card for presenting visual information during waving, the card comprising:

a flexible base element;

presenting elements for presenting visual information, the presenting elements including one or more rows of controllable light emitters, said light emitters being adapted to present the visual information as two-dimensional information when the presenting elements are exposed to a reciprocating movement during the waving, said light emitters being positioned on a first edge of the flexible base element;

a detecting element for detecting a bending of the base element during waving of the card;

a receiving element for receiving first information or signals, describing the movement of the presenting elements, from the detecting element and providing, on the basis of the first information, second information or signals for controlling the presenting elements, and for controlling the light emitters using the second information or signals.

2. The card according to claim 1, wherein the detecting element being positioned at or on a side of the base element and being adapted to output a signal corresponding to a stretching/compression of the detecting element.

3. The card according to claim 1, wherein the detecting element is selected from the group consisting of: piezo electric transducer, strain gauge, and pressure sensitive resistor.

4. The card according to claim 1, wherein the detecting element is additionally adapted to provide a sound corresponding to a received signal, the card further including a providing element for providing a signal to the detecting element.

5. The card according to claim 1, wherein the card has one or more opposing edges, the detecting element being positioned closer to the opposing edge(s) than to the first edge.

6. The card according to claim 1, wherein the receiving element additionally includes a timing element adapted to provide timing information, the receiving element providing the second information also on the basis of the timing information.

7. The card according to claim 6, wherein the receiving element is adapted to estimate, from the first information and the timing information, a first distance through which the providing element moves during a reciprocal movement.

8. The card according to claim 7, wherein the receiving element is adapted to hold 2D information to be provided, to sequentially forward, to the presenting elements, data representing neighboring, elongate parts of the 2D information.

9. The card according to claims 8, wherein the receiving element is adapted to relate an extent of the 2D information along a first dimension to the distance and to adapt the number of light emitters of each row of the presenting elements to have the 2D information presented by the card during the reciprocating movement have a predetermined relationship between a dimension along the direction of waving and a direction perpendicular thereto.

10. The card according to claim 8, wherein the receiving element is adapted to determine, from the 2D information, a second distance required to present the information and to forward to the presenting elements a part of the 2D information corresponding to a relation between the first and second distances.

11. The card according to claim 6, wherein the receiving element is adapted to estimate, on the basis of the first information and the timing information, a position of the providing element and to provide the second information on the basis of the estimated position.

12. The card according to claim 1, wherein the receiving element is adapted to estimate a curve, in a plane of the bending, adopted by the presenting elements, and to adapt the second information accordingly.

13. The card according to claim 1, wherein the detecting element is positioned at or on a side of the base element.

14. A method of operating the card for presenting visual information during waving, the method comprising:

providing a card that includes a flexible base element, presenting elements for presenting visual information, the presenting elements including one or more rows of controllable light emitters adapted to present the visual information as two-dimensional information when the presenting elements are exposed to a reciprocating movement during the waving, said light emitters being positioned on a first edge of the flexible base element, the card further including a detecting element for detecting a bending of the base element during waving of the card, and a receiving element for receiving first information or signals, describing the movement of the presenting elements, from the detecting element and providing, on the basis of the first information, second information or signals for controlling the presenting elements, and for controlling the light emitters using the second information or signals;

bending the card;

the detecting element providing the first information or signals to the receiving element;

the receiving element receiving the first information and providing the second information to the presenting element;

the presenting elements, as positioned on the first edge of the flexible base element, presenting visual information relating to the second information;

wherein the detection or quantification of the bending generates information describing the movement of the presenting elements, which information is used by the receiving element controlling the presenting element; and wherein the visual information is presented as two-dimensional information when the presenting elements are exposed to a reciprocating movement by waving the card.

15. The method according to claim 14, wherein the detecting element is positioned at or on a side of the base element and output a signal corresponding to a stretching/compression of the detecting element.

16. The method according to claim 14, wherein the detecting element additionally provides a sound corresponding to a signal.

17. The method according to claim 14, wherein the card has one or more opposing edges, the bending primarily taking place closer to the opposing edge(s) than to the first edge, and where the detecting element is positioned closer to the opposing edge(s) than to the first edge.

18. The method according to claim 14, further comprising providing timing information, where the second information is determined also on the basis of the timing information.

19. The method according to claim 18, further comprising the step of estimating, from the first information and the timing information, a first distance which the providing element moves during a reciprocal movement.

20. The method according to claim 19, wherein the receiving element holds 2D information to be provided, and sequentially forwards, to the presenting elements, data representing neighboring, elongate parts of the 2D information.

21. The method according to claims 20, further comprising relating an extent of the 2D information along a first dimension to the distance and adapting the extent of the information provided by the presenting step in a direction perpendicular to the direction of bending to have the 2D information presented by the card during the reciprocating movement have a predetermined relationship between a dimension along the direction of waving and a direction perpendicular thereto.

22. The method according to claim 20, further comprising determining, from the 2D information, a second distance required to present the information and to forward to the presenting elements a part of the 2D information corresponding to a relation between the first and second distances.

23. The method according to claim 19, further comprising estimating, on the basis of the first information and the timing information, a position of the providing element and providing the second information on the basis of the estimated position.

24. The method according to claim 14, further comprising estimating a curve, in a plane of the bending, adopted by the presenting elements, and adapting the second information accordingly.

25. The method according to claim 14, wherein the method includes positioning the detecting element at or on a side of the base element.

* * * * *